US007071608B2

(12) United States Patent
Nakamura et al.

(10) Patent No.: US 7,071,608 B2
(45) Date of Patent: Jul. 4, 2006

(54) IMAGE DISPLAY DEVICE

(75) Inventors: Tomoki Nakamura, Chiba (JP); Noriharu Matsudate, Kujukuri (JP)

(73) Assignee: Hitachi Displays, Ltd., Mobara (JP)

( * ) Notice: Subject to any disclaimer, the term of this patent is extended or adjusted under 35 U.S.C. 154(b) by 222 days.

(21) Appl. No.: 10/786,011

(22) Filed: Feb. 26, 2004

(65) Prior Publication Data

US 2004/0169459 A1 Sep. 2, 2004

(30) Foreign Application Priority Data

Feb. 27, 2003 (JP) ..... 2003-051349

(51) Int. Cl.
*H01J 63/04* (2006.01)

(52) U.S. Cl. ..... 313/495; 313/497

(58) Field of Classification Search ..... 313/422, 313/495–497

See application file for complete search history.

*Primary Examiner*—Vip Patel
(74) *Attorney, Agent, or Firm*—Antonelli, Terry, Stout and Kraus, LLP.

(57) ABSTRACT

In an image display device, assuming the distance between electron sources and control electrodes is Lkg, the distance between the control electrodes and acceleration electrodes is L12, the thickness of opening holes formed in the control electrodes is Tgl and the short diameter of the opening holes formed in the control electrodes is FGI, the acceleration electrodes satisfy the relationship (Lkg+Tgl+L12/2)/FGI≧0.25; assuming the thickness of the opening holes formed in the acceleration electrodes is Tg2 and the short diameter of the opening holes formed in the acceleration electrodes is FG2, the acceleration electrodes satisfy the relationship Tg2min≦Tg2≦Tg2max and the relationship Tg2min=2.98FG2−0.04; assuming FG2<0.109, the acceleration electrodes satisfy the relationship Tg2max=0.02/(0.115−FG2)−0.06; and assuming FG2≧0.109, the acceleration electrodes satisfy the relationship Tg2max=0.03/(FG2−0.1)+0.045. Due to such a constitution, light emission control can be easily performed and self-alignment of the electron sources and the control electrodes can be realized.

8 Claims, 11 Drawing Sheets

IMAGE DISPLAY DEVICE

BACKGROUND OF THE INVENTION

The present invention relates to an image display device which utilizes an emission of electrons into a vacuum to produce a display; and, more particularly, the invention relates to an image display device of the type described which exhibits high brightness and excellent image reproducibility by enhancing the electron emission characteristics of the electrons emitted from the electron sources and the focusing characteristics of the electron beams.

As an image display device which exhibits a high brightness and high definition, color cathode ray tubes have been popularly used conventionally up to now. However, along with a recent demand for the provision of higher quality images in information processing equipment or in television broadcasting, the demand for planar displays (panel displays) which are light in weight and require a small space, while exhibiting a high brightness and high definition has been increasing.

As typical examples, liquid crystal display devices, plasma display devices and the like have been put into practice. Further, as display devices which can realize higher brightness, various kinds of panel-type display devices, including a display device which utilizes an emission of electrons from electron sources into a vacuum space (hereinafter referred to as an electron emission type display device or a field emission type display device) and an organic EL display device, which is characterized by low power consumption, have been commercialized.

Among such panel type display devices, such as the above-mentioned field emission type display device, there are a display device having an electron emission structure, which was proposed by C. A. Spindt et al. (see U.S Patent Specification 3453478, Japanese Unexamined Patent Publication 2000-21305, for example), a display device having an electron emission structure of a metal-insulator-metal (MIM) type, a display device having an electron emission structure which utilizes an electron emission phenomenon based on a quantum theory tunneling effect (also referred to as "surface conduction type electron source, see Japanese Unexamined Patent Publication 2000-21305), and a display device which utilizes an electron emission phenomenon having a diamond film, a graphite film and carbon nanotubes and the like, for example.

The above-mentioned field emission type display device is configured such that the display device includes a back substrate, on which cathode lines having field emission type electron sources are formed on inner surfaces thereof along with control electrodes, and a face substrate, on which forms anodes and phosphor layers are formed on an inner surface thereof which faces the back substrate. The back substrate and the face substrate are laminated to each other with a sealing frame interposed between inner peripheral portions thereof to form a space in a vacuum state therebetween. Further, there is also a known structure in which, to maintain a desired distance between the back substrate and the face substrate at a given value, distance holding members are provided between the back substrate and the face substrate. Here, this type of device is described in Japanese Unexamined Patent Publication Hei10 (1998)-134701, Japanese Unexamined Patent Publication 2000-306508 and the like.

SUMMARY OF THE INVENTION

A field emission type display device having such a constitution is provided with control electrodes having electron passing holes between the electron sources formed in the cathode lines disposed on the back substrate and anodes formed on the face substrate, wherein by imparting a given potential difference to the control electrodes with respect to the cathode lines, electrons are pulled out from the electron sources, these electrons are made to pass through the electron passing holes formed in the control electrodes and are made to impinge on phosphors at an anode side, whereby an image display is produced.

However, in the image display device having such a constitution, the control electrodes are constituted of a large number of strip-like electrode elements which are arranged in parallel and are disposed close to the electron sources. The current density of the electrons pulled out of the electron sources depends on electric fields which are formed between the electron passing holes formed in the strip-like electrode elements which constitute the control electrodes and the cathode lines. That is, an increase in the number of electron passing holes, an increase in the hole diameter of the electron passing holes and the application of a high voltage do not always increase the current density. Further, even when the current which is made to flow in the cathode lines is simply increased, the current density per pixel cannot be increased.

Further, the strip-like electrode elements which constitute the control electrodes are formed in an extremely minute web form, and, hence, it is desirable that the hole diameter of the electron passing holes is as small as possible from the viewpoint of mechanical strength. However, when the hole diameter of the electron passing holes is made excessively small, the absolute quantity of electrons taken out through the control electrodes is limited, and, hence, there is a limitation with respect to the reduction of the hole diameter of the electron passing holes.

Further, the strip-like electrode elements (MRG) which constitute the control electrodes are formed in an extremely minute web form using a thin film or a thin plate made of a metal material having a thickness of approximately 0.05 mm. Accordingly, the electric field generated between the control electrodes and the anodes and the electric field generated between the control electrodes and the cathode lines influence each other, and, hence, there has been a drawback in that achieving an optimum design of the electron emission characteristics and the electron beam focusing characteristics is difficult.

Further, it is extremely difficult to ensure with high accuracy the coaxiality between a large number of electron sources formed on the cathode lines of the back substrate and respective open holes formed in the control electrodes corresponding to these respective electron sources over the whole surface of a display region, and, hence, the electrons emitted from the electron sources flow into the control electrodes, whereby there have been drawbacks in that the display efficiency is lowered, a disturbance is generated with respect to the anode current, and the display efficiency is lowered.

Further, the CNT (carbon nanotubes) which constitute the electron sources tend to be degenerated and dissipated due to heat treatment during certain manufacturing steps, and, hence, a fluctuation (irregularities) of the light-emitting starting voltage is generated, whereby a sufficient electron emission quantity is not obtained. Accordingly, it is necessary to largely increase the drive voltage, and, hence, there has been a drawback in that it becomes difficult to provide electron sources which can produce a uniform electron emission.

Accordingly, the present invention has been made to solve the above-mentioned conventional drawbacks, and it is an object of the present invention to provide an image display device which can reduce the mutual influence attributed to an electric field between respective electrodes and can obtain a high current density with low voltage driving by defining the relationship among a size between acceleration electrodes and control electrodes, a size between the control electrodes and cathode lines, short diameters of electron passing holes formed in the control electrodes and the acceleration electrodes, and the thicknesses of the control electrodes and the acceleration electrodes.

Further, it is another object of the present invention to provide an image display device that is capable of obtaining high performance and high reliability by reducing a lowering of the electron emission characteristics and the electron beam focusing characteristics.

To achieve such objects, an image display device according to the present invention includes:

(1) a face substrate on which anodes and phosphors are formed on an inner surface thereof;

(2) a back substrate which has a plurality of cathode lines which extend in one direction and are arranged in parallel in another direction which intersects one direction and which include electron sources; control electrodes which are arranged to face the cathode lines in a non-contact manner and include a plurality of electron passing holes which allow electrons emitted from the electron sources to pass therethrough to an inner surface side of the face substrate in regions which respectively face the electron sources, and which control the emission quantity of electrons emitted from the electron sources; and acceleration electrodes which face the control electrodes in a non-contact manner, include a plurality of electron passing holes which allow the electrons which pass through the electron passing holes formed in the control electrodes to pass therethrough in regions which respectively face the respective electron passing holes formed in the control electrodes, and accelerate the electrons which pass through the electron passing holes on an inner surface thereof, and face the face substrate with a given distance therebetween; and (3) a frame body which is inserted between the face substrate and the back substrate while surrounding a display region and which holds a given distance between the face substrate and the back substrate. In the arrangement described above, assuming a distance between the electron sources and the control electrodes as Lkg, a distance between the control electrodes and the acceleration electrodes as L12, a thickness of the electron passing holes formed in the control electrodes as Tgl and a short diameter of the electron passing holes formed in the control electrodes as FGI, the acceleration electrodes satisfy the relationship $(Lkg+Tgl+L12/2)/FGI \geqq 0.25$.

Further, assuming a thickness of the electron passing holes formed in the acceleration electrodes as Tg2 and a short diameter of the electron passing holes of the acceleration electrodes as FG2, the acceleration electrodes satisfy the relationship $Tg2min \leqq Tg2 \leqq Tg2max$ and the relationship $Tg2min=2.98FG2-0.04$. Also, assuming $FG2<0.109$, the acceleration electrodes satisfy the relationship $Tg2max=0.02/(0.115-FG2)-0.06$, and assuming $FG2 \geqq 0.109$, the acceleration electrodes satisfy the relationship $Tg2max=0.03/(FG2-0.1)+0.045$.

Further, another image display device according to the present invention includes:

(1) a face substrate which forms anodes and phosphors on an inner surface thereof;

(2) a back substrate which has a plurality of cathode lines which extend in one direction and are arranged in parallel in another direction which intersects one direction and include electron sources; control electrodes which are arranged to face the cathode lines in a non-contact manner, include a plurality of electron passing holes which allow electrons emitted from the electron sources to pass therethrough to an inner surface side of the face substrate in regions which respectively face the electron sources and control an emission quantity of electrons emitted from the electron sources; and acceleration electrodes which face the control electrodes in a non-contact manner, include a plurality of electron passing holes which allow the electrons which pass through the electron passing holes formed in the control electrodes to pass therethrough in regions which respectively face the respective electron passing holes formed in the control electrodes, the electron passing holes being formed while having an N-stage structure in which the open hole diameter thereof is gradually increased in the direction toward the face substrate, and accelerate the electrons which pass through the electron passing holes on an inner surface thereof, and face the face substrate with a given distance therebetween; and (3) a frame body which is inserted between the face substrate and the back substrate while surrounding a display region and holds a given distance between the face substrate and the back substrate. In this arrangement, assuming a distance between the electron sources and the control electrodes as Lkg, a distance between the control electrodes and the acceleration electrodes as L12, a thickness of the electron passing holes formed in the control electrodes as Tgl and a short diameter of the electron passing holes formed in the control electrodes as FGI, the acceleration electrodes satisfy the relationship $(Lkg+Tgl+L12/2)/FGI \geqq 0.25$.

Further, assuming a thickness of a first-stage open hole of the electron passing hole of the acceleration electrode as Tg2-1, a thickness(depth) of open holes ranging from the first-stage open hole to an Nth-stage open hole of the electron passing hole of the acceleration electrode as Tg2-N, a short diameter of the first-stage open hole of the electron passing hole of the acceleration electrode as FG2-1, a short diameter of the Nth-stage open hole of the electron passing hole of the acceleration electrode as FG2-N, a minimum value of a thickness (depth) of open holes ranging from the first-stage open hole to the Nth-stage open hole as Tg2min-N, and a maximum value of a thickness (depth) of open holes ranging from the first-stage open hole to the Nth-stage open hole as Tg2max-N, the acceleration electrodes satisfy the relationship $FG2\text{-}1<FG2\text{-}2< \ldots <FG2\text{-}N$, wherein with respect to at least one Tg2-N, the relationship $Tg2\text{-}N \geqq Tg2min\text{-}N$ is satisfied, and with respect to all Tg2-N, the relationship $Tg2\text{-}N \leqq Tg2max\text{-}N$ is satisfied.

Further, another image display device according to the present invention includes:

(1) a face substrate which forms anodes and phosphors on an inner surface thereof;

(2) a back substrate which has cathodes which form electron sources on a display region; control electrodes which are arranged to face the cathodes in a non-contact manner, include a plurality of electron passing holes which allow electrons emitted from the electron sources to pass therethrough to an inner surface side of the face substrate in regions which respectively face the electron sources and control an emission quantity of electrons emitted from the electron sources; and acceleration electrodes which face the control electrodes in a non-contact manner, include a plurality of electron passing holes which allow the electrons which pass through the electron passing holes formed in the control electrodes to pass therethrough in regions which respectively face the respective electron passing holes formed in the control electrodes, and accelerate the electrons which pass through the electron passing holes toward the inner surface side of the face substrate on an inner surface thereof, and face the face substrate with a given distance therebetween; and (3) a frame body which is inserted between the face substrate and the back substrate while surrounding a display region and holds a given distance between the face substrate and the back substrate.

In this arrangement, assuming a distance between the electron sources and the control electrodes as Lkg, a distance between the control electrodes and the acceleration electrodes as L12, a thickness of the electron passing holes formed in the control electrodes as Tgl and a short diameter of the electron passing holes formed in the control electrodes as FGI, the acceleration electrodes satisfy the relationship $(Lkg+Tgl+L12/2)/FGI \geqq 0.25$.

Further, assuming a thickness of the electron passing holes formed in the acceleration electrodes as Tg2 and a short diameter of the electron passing holes of the acceleration electrodes as FG2, the acceleration electrodes satisfy the relationship $Tg2min \leqq Tg2 \leqq Tg2max$ and the relationship $Tg2min=2.98FG2-0.04$.

Also, assuming $FG2<0.109$, the acceleration electrodes satisfy the relationship $Tg2max=0.02/(0.115-FG2)-0.06$, and assuming $FG2 \geqq 0.109$, the acceleration electrodes satisfy the relationship $Tg2max=0.03/(FG2-0.1)+0.045$, and matrix driving is performed using the control electrodes and the acceleration electrodes.

Further, in another image display device according to the present invention, it is desirable that the control electrodes and the acceleration electrode have an electrode structure made of conductive metal plate members. Further, it is desirable that the electron sources and the cathodes are made of carbon nanotubes. Still further, the control electrodes and the acceleration electrodes may adopt any one of a laminated film electrode structure formed of conductive metal films, a laminated electrode structure in which conductive metal films are formed on both surfaces of an insulation substrate, and a laminated electrode structure in which strip-like electrode elements are formed on a cathode side of an insulation substrate and conductive metal films are formed on an anode side of the insulation substrate.

Due to the above-mentioned respective constitutions of the present invention, by performing triode electron emission by defining respective distances among the electron sources, the control electrodes and the acceleration electrodes, the thicknesses of the control electrodes and the acceleration electrodes and the open hole diameters of the electron passing holes, it is possible to obtain a high current density with low-voltage driving.

Further, according to another image display device of the present invention, by forming the cathodes using a single electrode and performing triode electron emission, the electron sources of the cathodes and the electron passing holes formed in the control electrodes are aligned in a self-alignment manner, and, hence, it is possible to set the inflow current to the control electrodes to zero by self-alignment of the electric field.

The present invention is not limited to the above-mentioned constitutions and the constitutions of embodiments described later and various modifications can be made without departing from the technical concept of the present invention.

DESCRIPTION OF THE PREFERRED EMBODIMENTS

Figure 1:
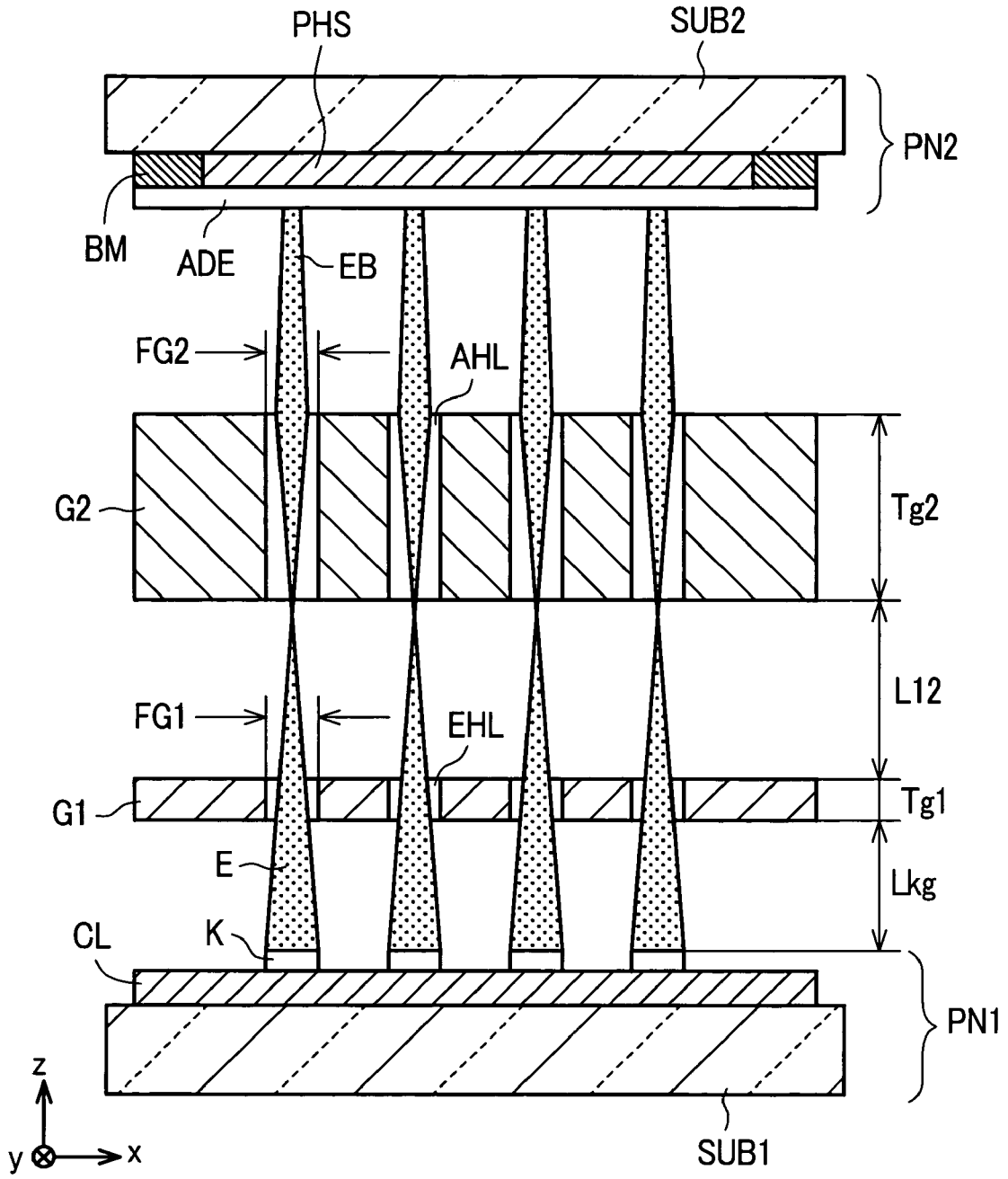
FIG. 1 is an enlarged cross-sectional view of the vicinity of one pixel schematically showing one embodiment of an image display device according to the present invention.

Preferred embodiments of the present invention will be explained in detail hereinafter in conjunction with the drawings. In FIG. 1, symbol SUB1 indicates a back substrate which is formed of an insulation substrate preferably made of glass or the like and constitutes a back panel PN1. On an inner surface of the back substrate SUB1, a plurality of cathode lines CL having electron sources K extend in one direction x (horizontal direction in this embodiment) and are arranged in parallel in another direction y (vertical direction in this embodiment).

Further, over the back panel PN1, control electrodes G1 each having a plurality of electron passing holes EHL, which allow electrons E emitted from the electron sources K to pass therethrough to a face panel PN2 side, are arranged in a non-contact state with the back panel PNL. Here, the control electrodes G1 intersect the cathode lines CL in a non-contact state, extend in the y direction and are arranged in the x direction in parallel and form pixels at intersecting portions thereof with the cathode lines CL. Further, over the control electrodes GI, acceleration electrodes G2 having electron passing holes AHL in regions which face the respective electron passing holes EHL formed in the control electrode G1 in an opposed manner are arranged in a non-contact state.

Here, the cathode lines CL are formed by patterning a conductive paste containing silver or the like by printing and, thereafter baking the patterned conductive paste. Further, the electron sources K which are arranged on upper surfaces (face-substrate-SUB2-side) of intersection portions between these cathode lines CL and the control electrodes G1 are formed of CNT (carbon nanotubes), for example. As an example, the cathode lines CL are formed by patterning an Ag-B-CNT paste by printing and baking the printed paste. Further, the control electrodes G1 and the acceleration electrodes G2 are formed of a conductive metal plate material, such as nickel, for example, and the electron passing holes EHL and the electron passing holes AHL are formed in the control electrodes G1 and the acceleration electrodes G2 by etching or press forming.

On the other hand, a face panel PN2 is laminated to the back panel PN1 with a given distance therebetween in the z direction using a frame body (not shown in the drawing). The face panel PN2 includes phosphors PHS which are partitioned by black matrixes BM and anodes ADE on an inner surface of a face substrate SUB2 formed of a light-transmitting insulation substrate made of glass or the like. A space defined between the back panel PN1 and the face panel PN2 is sealed in a vacuum state.

In such a constitution, a triode operation, in which the control electrodes G1 have a potential lower than the potential of the electron sources K and the electron sources K emit electrons E in response to a potential of the acceleration electrodes G2, is performed. The electrons E which are emitted from the electron sources K by the triode operation pass through the electron passing holes EHL of the control electrodes G1 in a state wherein the electron quantity is controlled and, then, pass through the electron passing holes AHL of the acceleration electrodes G2. Here, the electrons are accelerated by the electron passing holes AHL and are directed to the anodes ADE as electron beams EB so as to excite the phosphors PHS, thereby to make the phosphors PHS emit light at a given wavelength. A display region is formed on the face panel PN2 by arranging the pixels two-dimensionally and images are displayed on the display region.

Figure 2:
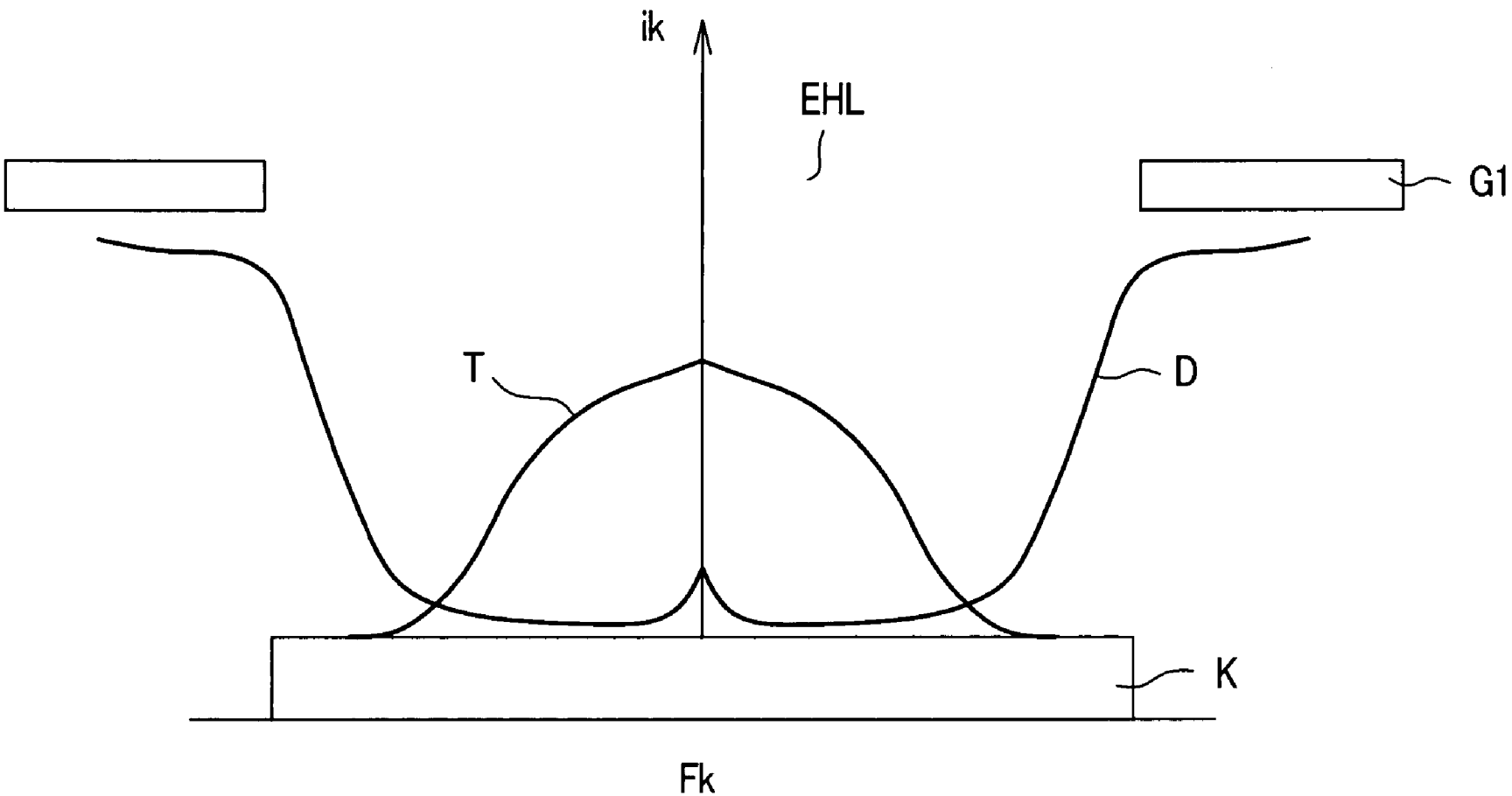
FIG. 2 is a diagram showing electron emission characteristics when a triode operation and a diode operation of the image display device shown in FIG. 1 are compared to each other.

To compare the triode operation and the diode operation with respect to the electron emission characteristics, in FIG. 2, the diameter FK of the electron sources K is taken along an axis of abscissas and the current density ik is taken on an axis of ordinates. In the drawing, symbol T indicates the triode operation characteristics and symbol D indicates the diode operation characteristics. In the diode operation, the control electrode G1 disposed above the electron source K possesses a positive potential with respect to the electron source K and directly pulls out the electrons E from the electron source K; and, hence, the current density becomes higher in the vicinity or right below the control electrode G1 (a portion surrounding the electron passing hole EHL) than in the main portion of the electron passing hole EHL. Here, when the range of the electron source K with respect to the electron passing hole EHL of the control electrode G1 is not controlled, the cathode current contains a large quantity of an inflow current to the control electrode G1. On the other hand, although an attempt is made to set the inflow current to the control electrode G1 to zero by controlling the diameter and the position of the electron source K, the high current density region in the vicinity of the control electrode G1 cannot be utilized, and, hence, the electric current quantity is decreased.

On the other hand, in the triode operation, the control electrode G1 disposed above the electron source K possesses a negative potential with respect to the electron source K and performs a function of suppressing the infiltration of an electric field to the electron source K. As a result, the electron emission characteristics are self-aligned with respect to the electron passing hole EHL of the control electrode G1, whereby the largest current density appears at a center portion of the electron passing hole EHL and the current density becomes zero in the vicinity of the control electrode G1 (an outer peripheral portion of the electron passing hole EHL). Accordingly, even when the diameter and the position of the electron source K are not controlled with high accuracy, the inflow current to the control electrode G1 becomes zero, and, hence, it is possible to obtain the maximum current structurally.

Figure 3:
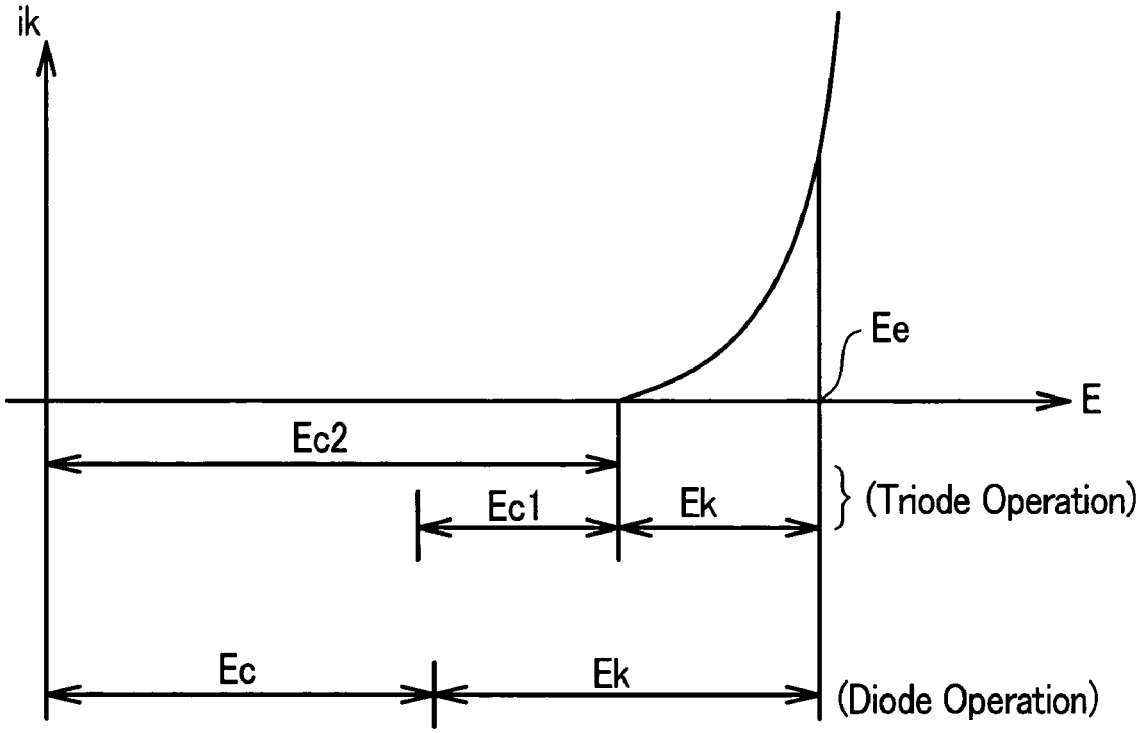
FIG. 3 is a graph showing electron emission characteristics when carbon nanotubes (CNT) are used as electron sources of the image display device shown in FIG. 1.

FIG. 3 is a view showing the electron emission characteristics of the electron source K when CNT(carbon nanotubes) are used as the electron emission material of the electron source K. In FIG. 3, the field strength E of the vicinity of the electron source is taken on an axis of abscissas and the current density ik is taken on an axis of ordinates. That is, FIG. 3 shows a comparison of the voltage distribution in the diode operation and the triode operation. In the diode operation, it is necessary to apply an electric field Ee which is necessary for field emission as a potential difference formed of a potential Ek of the electron source K and a potential Ec of the control electrode G1 disposed above the electron source K. As a result, when the electron emission characteristics of the CNT are deteriorated, it is necessary to increase the drive voltages for the electron source K and the control electrode G1 that is disposed above the electron source K.

On the other hand, in the triode operation, an electric field Ee which is necessary for field emission is given as a potential difference formed of the potential Ek of the electron source K, a potential Ecl of the control electrode G1 and a potential Ec2 of the acceleration electrode G2. Accordingly, by supplying a bias amount before the start of electron emission to the acceleration electrode G2 as a DC voltage, even when the CNT characteristics are deteriorated, it is possible to obtain a desired current without increasing the drive voltages of the electron source and the control electrode.

Figure 4:
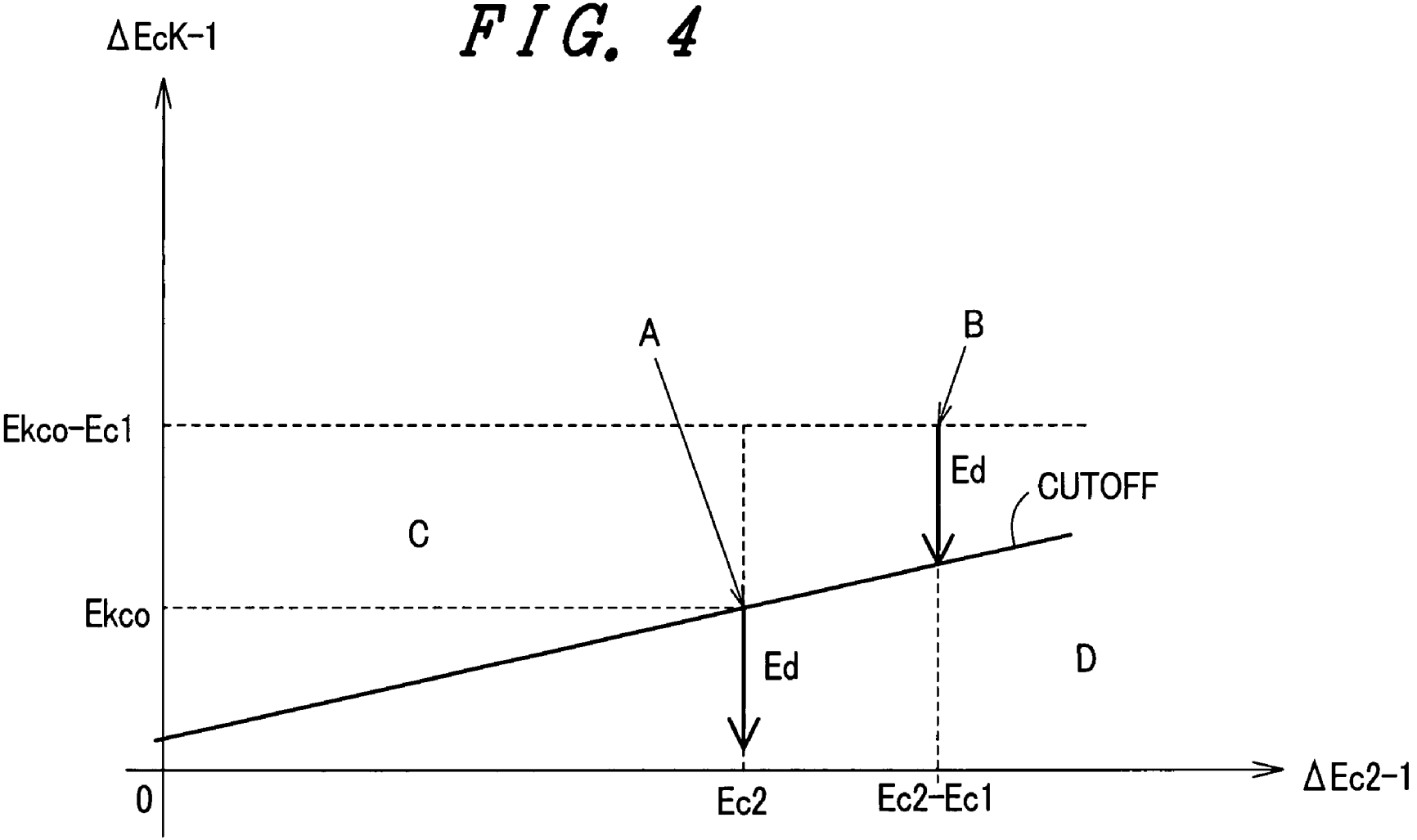
FIG. 4 is a graph showing the relationship between driving states and operation points when the triode of the image display device shown in FIG. 1 is operated.

FIG. 4 is a view showing the driving states and operation points at the time of performing the triode operation, wherein a potential difference ΔEc2-1 between a potential Ec2 of the acceleration electrode G2 and a potential Ec1 of the control electrode G1 is taken on an axis of abscissas and a potential difference ΔEcK-1 between a potential Ekco of the electron source K and a potential Ec1 of the control electrode G1 is taken on an axis of ordinates. Further, in the drawing, symbol CUTOFF indicates the cutoff (brightness point erasing) characteristics, wherein a point A represents the operation point when the pixel is selected, the point B represents the operation point when the pixel is not selected, and symbol Ed indicates a maximum amplitude of the cathode signal. Further, a portion C above the CUTOFF indicates a region where the pixel does not emit light, and a portion D below the CUTOFF indicates a region where the pixel emits light.

As shown in FIG. 4, the potential Ec1 of the control electrode G1 becomes 0V when the pixel is selected. Here, a DC current Ec2 applied to the acceleration electrode G2 is adjusted such that the cutoff voltage Ekco of the electron source K assumes an optimum value with respect to the drive circuit. A video signal is inputted with a negative polarity with respect to the cutoff voltage Ekco, which constitutes a reference point. When the pixel is not selected, the potential Ec1 of the control electrode G1 assumes a value below 0V. As shown in FIG. 4, since the operation point B of the electron source K is given with respect to the potential Ec1 of the control electrode G1 which constitutes the reference, the operation point B is offset in the direction in which the light is not emitted from the pixel. Further, the maximum amplitude Ed of the signal applied to the electron source K is defined by the maximum voltage which does not generate emission of light from the pixel with respect to the operation point A at the time of selecting the pixels.

Figure 5:
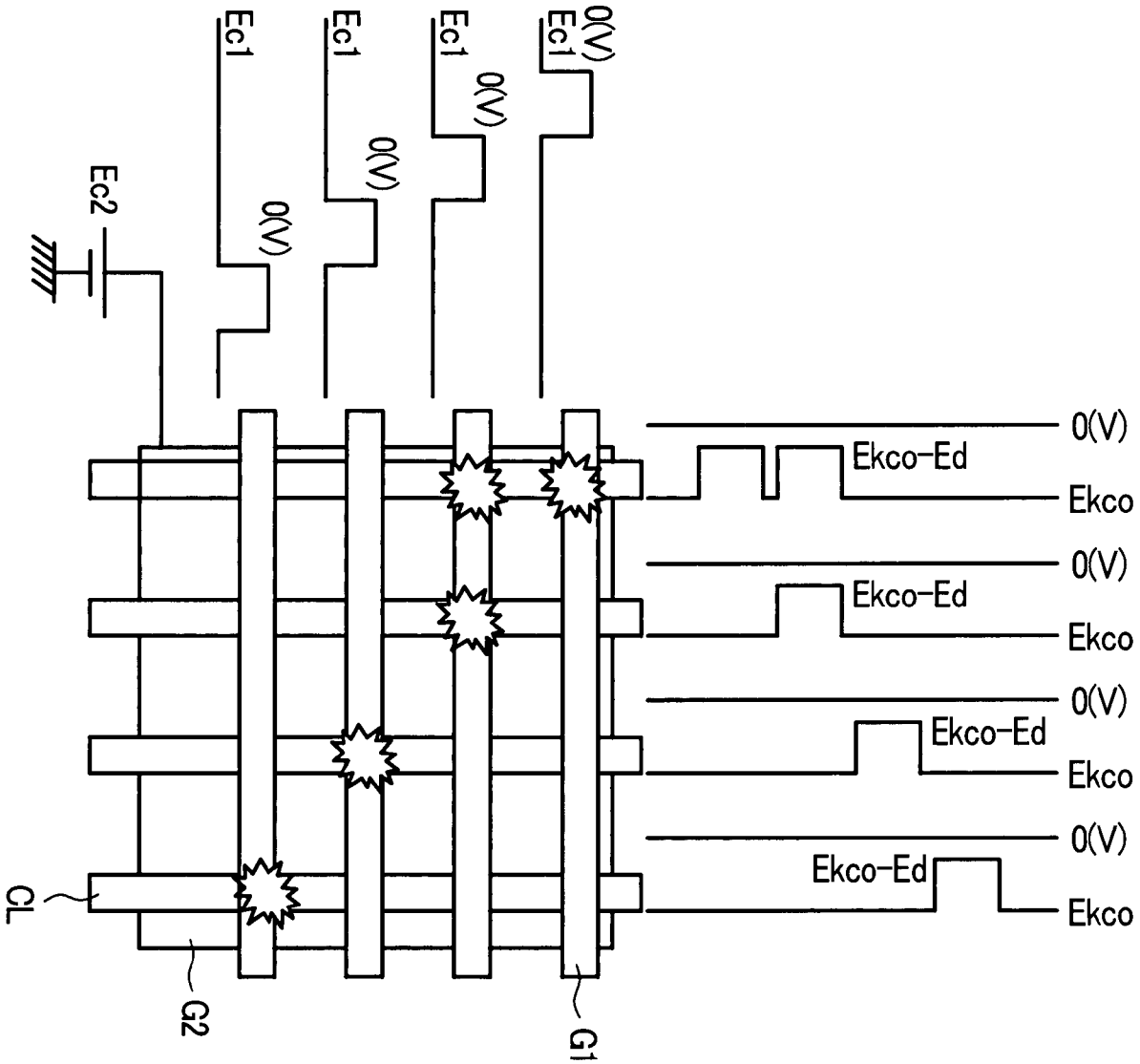
FIG. 5 is a timing chart of driving pulses which are applied to respective electrodes when the triode operation of the image display device shown in FIG. 1 is performed.

Accordingly, as shown in FIG. 5, by performing the matrix driving in a state in which the DC voltage Ec2 is applied to the acceleration electrode G2, the drive pulse of the potential Ekco is applied to the cathode line CI and the drive pulse of the potential Ec1 is applied to the control electrode G1 under the above-mentioned conditions, and, hence, it is possible to perform the triode operation.

Next, the dimensions of the electrodes in the triode operation mode will be explained. Among the dimensions of the electrodes, the dimensions which influence the emission of the electrons E from the electron source K are, as shown in FIG. 1, an open hole shape of the electron passing hole EHL formed in the control electrode G1, an open hole shape of the electron passing hole AHL at a control electrode G1 side formed in the acceleration electrode G2, a distance Lkg between the electron source K and the control electrode G1, a distance L12 between the control electrode G1 and the acceleration electrode G2, and a thickness (depth) Tg1 of the electron passing hole EHL formed in the control electrode Tg1.

In general, the pixel arrangement of the matrix display adopts a parallel arrangement. Accordingly, the basic shape of the pixels is a square shape or a rectangular shape, and, hence, it is desirable that the respective electron passing holes EHL, AHL have a simple shape, such as a rectangular shape, an oblong shape, a circular shape or the like. Further, when the hole shape of the electron passing hole AHL at the control electrode G1 side formed in the acceleration electrode G2 has a smaller hole diameter than the hole shape of the electron passing hole EHL formed in the control electrode G1, the original control function of the control electrode G1 is lowered, and, hence, an inflow current to the acceleration electrode G2 is liable to be easily generated. Accordingly, the formation of electron passing holes AHL, EHL having such hole shapes is not desirable.

Figure 6:
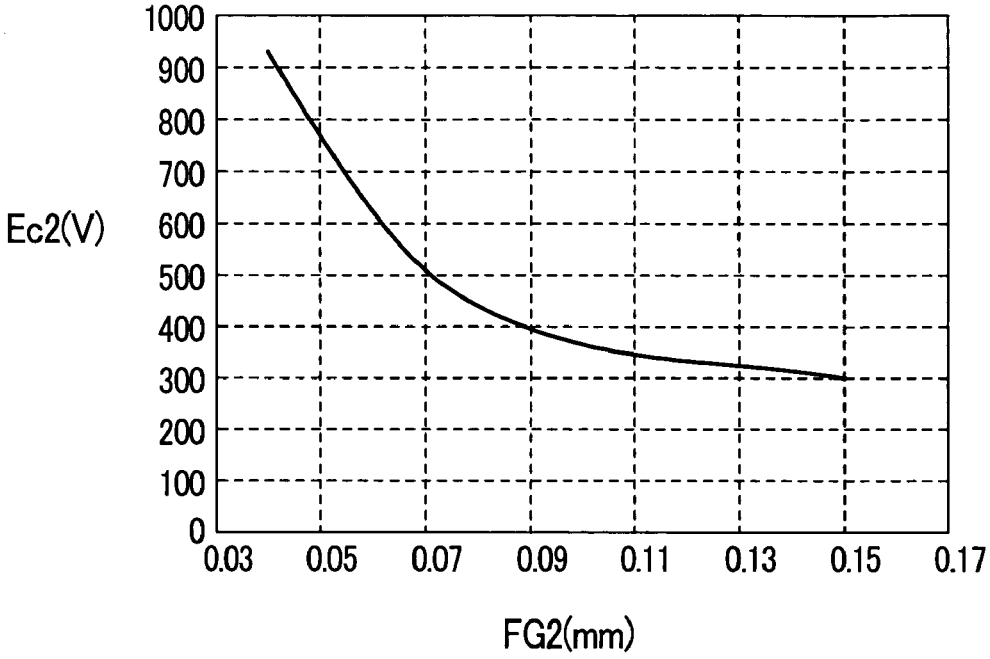
FIG. 6 (*a*) and FIG. 6 (*b*) are graphs showing the relationship of a change of a potential of acceleration electrodes with respect to a hole diameter of electron passing holes formed in the acceleration electrode.
Figure 6:
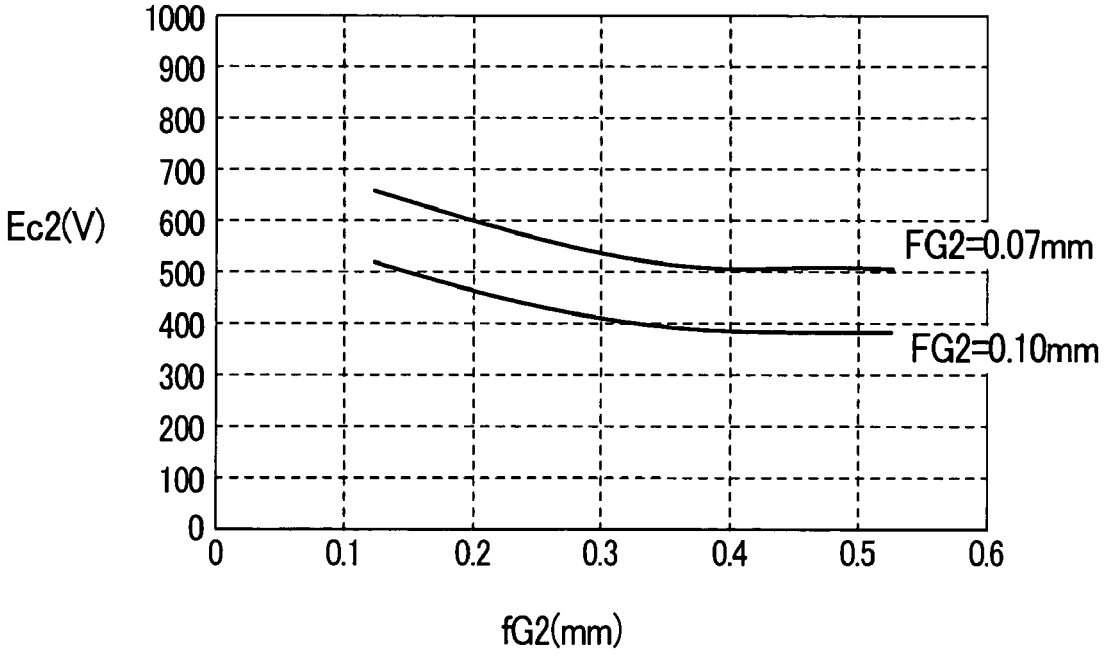

Here, FIG. 6(*a*) and FIG. 6(*b*) show the change of the potential Ec2 of the acceleration electrode G2 when the cutoff voltage Ekco assumes 40V, for example, in a state in which the hole shape of the electron passing hole AHL formed in the acceleration electrode G2 is oblong. FIG. 6(*a*) shows the change of the potential Ec2 of the acceleration electrode G2 with respect to the short diameter FG2 of the electron passing hole AHL, and FIG. 6(*b*) shows the change of the potential Ec2 of the acceleration electrode G2 with respect to the long diameter fG2 of the electron passing hole AHL. FIG. 6(*a*) shows the change of the potential Ec2 of the acceleration electrode G2 with respect to the short diameter FG2 of the electron passing hole AHL when the distance Lkg between the electron source K and the control electrode G1 is set to 0.02 mm, the distance L12 between the control electrode G1 and the acceleration electrode G2 is set to 0.1 mm, the thickness Tg1 of the electron passing hole EHL formed in the control electrode G1 is set to 0.001 mm, and the long diameter fG2 of the acceleration electrode G2 is set to 0.52 mm. On the other hand, FIG. 6(*b*) shows the change of the potential Ec2 of the acceleration electrode G2 with respect to the long diameter fG2 of the electron passing hole AHL when the distance Lkg between the electron source K and the control electrode G1 is set to 0.02 mm, the distance L12 between the control electrode G1 and the acceleration electrode G2 is set to 0.1 mm, the thickness Tg1 of the electron passing hole EHL formed in the control electrode G1 is set to 0.001 mm, and the short diameter FG2 of the electron hole AHL formed in the acceleration electrode G2 is set to 0.07 mm and 0.1 mm.

As shown in FIG. 6(*a*) and FIG. 6(*b*), the change of the short diameter FG2 of the electron passing hole AHL formed in the acceleration electrode G2 gives a strong influence to the potential Ec2 of the acceleration electrode G2 compared to the change of the long diameter fG2. Accordingly, the electrode dimensions in the triode operation mode are determined based on the short diameter FG1 of the electron passing hole EHL formed in the control electrode G1, the short diameter FG2 of the electron passing hole AHL formed in the acceleration electrode G2, the distance Lkg between the electron source K and the control electrode G1, the distance L12 between the control electrode G1 and the acceleration electrode G2, and the thickness Tg1 of the electron passing hole EHL formed in the control electrode G1 shown in FIG. 1.

Further, although the triode operation is performed by the constitution formed of the electron source K, the control electrode G1 and the acceleration electrode G2, when the distance Lkg between the electron source K and the control electrode G1, the distance L12 between the control electrode G1 and the acceleration electrode G2, and the thickness Tg1 of the electron passing hole EHL formed in the control electrode G1 are small compared to the short diameter FG1 of the electron passing hole EHL formed in the control electrode G1 and the short diameter FG2 of the electron passing hole AHL formed in the acceleration electrode G2, the control action of the control electrode G1 is decreased and the electron emission approaches the diode characteristics.

Figure 7:
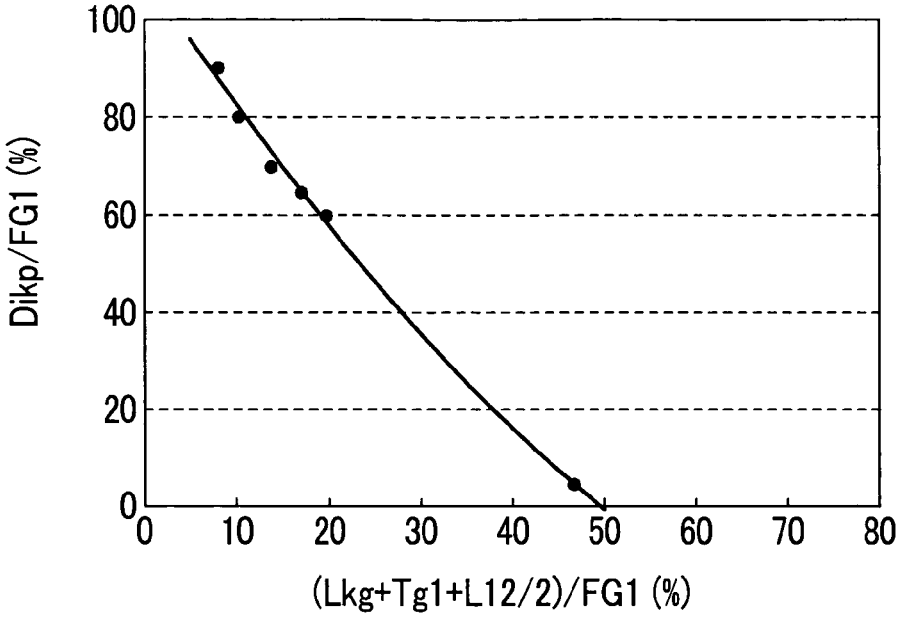
FIG. 7 is a graph showing the relationship of a peak of a current density in electron sources with respect to the hole diameter of the electron passing holes formed in the control electrode.

FIG. 7 is a view in which the rate of (Lkg+Tg1+L12/2)/FG1 is taken on an axis of abscissas and the rate Dikp/FG1, which is the rate of a peak diameter Dikp of current density in the electron source K with respect to the short diameter FG1 of the electron passing hole EHL formed in the control electrode G1, is taken on an axis of ordinates, and this graph shows the relative positions of peak regions of the current density with respect to the electron passing hole. Here, the reason why only the distance L12 between the control electrode G1 and the acceleration electrode G2 is multiplied by ½ times is that the degree of influence to which the distance L12 affects the electron source K is relatively small compared to the above-mentioned distance Lkg and thickness Tg1, and it becomes substantially ½ (the experimental value obtained in a cathode-ray-tube electron gun).

As shown in FIG. 7, when the value (Lkg+Tg1+L12/2)/FG1 becomes small, the peaks of the current density form a crater-shaped distribution which is formed so as to surround the center of the electron passing hole along the periphery of the electron passing hole EHL formed in the control electrode G1 and approaches the diode characteristics indicated by D shown in FIG. 2. The above-mentioned peak diameter Dikp of the current density is defined by two peak distances which appear when the crater-like peak distribution is shown in a cross section like the cross section shown in FIG. 2. It is in a range of (Lkg+Tg1+L12/2)/FG1≧0.25 that the peak diameter of the current density falls inside 50% of the hole diameter, and, hence, the characteristics of the triode is strengthened. Further, it is in a range of (Lkg+Tg1+L12/2)/FG1≧0.50 that the peak value of the current density is present at the center portion of the electron passing hole EHL formed in the control electrode G1, and, hence, the complete triode characteristics are obtained.

Next, the optimization of the triode characteristics of the acceleration electrode G2 will be explained. When the thickness Tg2 of the electron passing hole AHL formed in the acceleration electrode G2 is increased, an electron lens, which is constituted of the electron source K, the control electrode G1 and the acceleration electrode G2, and an electron lens, which is constituted of the acceleration electrode G2 and the anode ADE, are completely separated, and, hence, it is possible to design the electron emission characteristics and the electron beam focusing characteristics independently. However, when the thickness Tg2 of the electron passing hole AHL formed in the acceleration electrode G2 is excessively increased, the electron beams which are once focused by the control electrode G1 diverge, and, hence, an inflow current to the acceleration electrode G2 is generated. In view of the above, there exists an optimum value with respect to the thickness Tg2 of the electron passing hole AHL formed in the acceleration electrode G2.

Here, to take the case of the diode operation into consideration, it is possible to make the electron emission characteristics and the electron beam focusing characteristics independent from each other by increasing the thickness Tg1 of the electron passing hole EHL formed in the control electrode G1. However, since the control electrode G1 does not have the focusing function to focus the emitted electrons, the larger the thickness Tg1 of the electron passing hole EHL formed in the control electrode G1, the more the inflow current to the control electrode G1 is increased, whereby the quantity of electrons which reach the anode ADE is decreased. Here, when the thickness Tg1 the electron passing hole EHL formed in the control electrode G1 is made small to decrease the inflow current to the control electrode G1, the electron emission characteristics and the electron beam focusing characteristics cannot be separated. Accordingly, the optimum design becomes extremely difficult to attain in the diode operation.

Assuming that the acceleration electrode G2 has a one-stage constitution and a short diameter of the electron passing hole AHL is set to FG2, a minimum thickness Tg2min of the electron passing hole AHL formed in the acceleration electrode G2 which can separate the electron lens, which is constituted of the electron source K, the control electrode G1 and the acceleration electrode G2, and the electron lens, which is constituted of the acceleration electrode G2 and the anode ADE, is obtained by a three-dimensional electron beam locus analysis. Further, the maximum thickness Tg2max of the electron passing hole AHL formed in the acceleration electrode G2 which can prevent the impingement of the electron beams on the acceleration electrode G2 is also obtained by a three-dimensional electron beam locus analysis. The result of the analysis is shown in FIG. 8.

Figure 8:
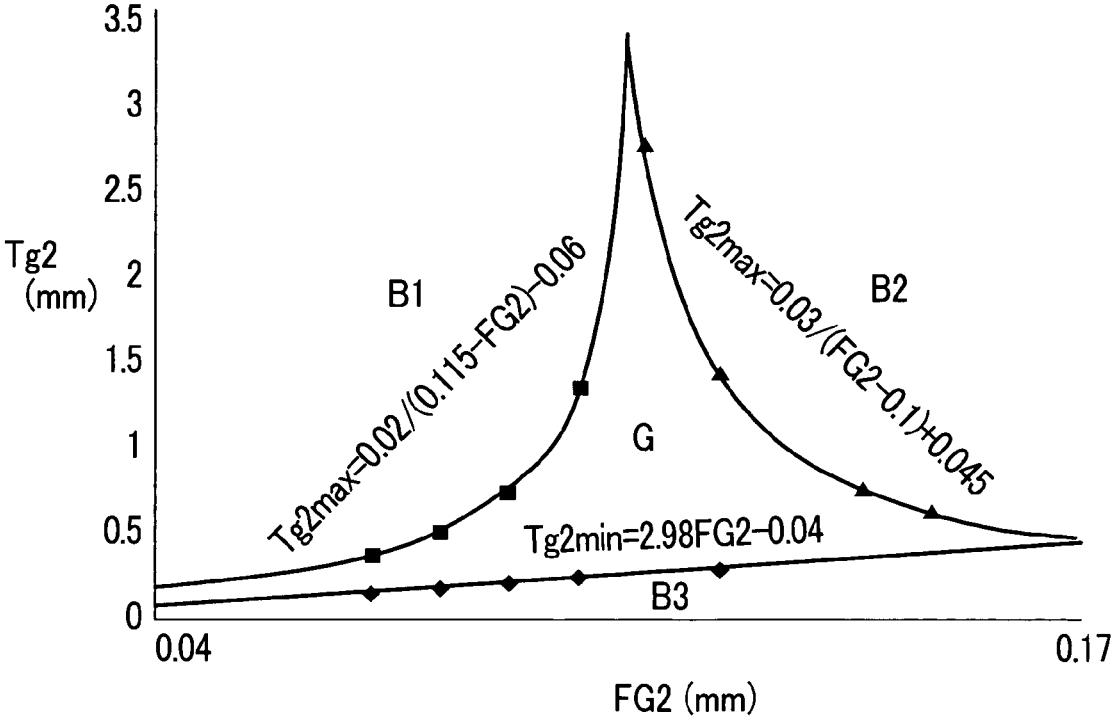
FIG. 8 is a graph showing the relationship of thicknesses of acceleration electrodes with respect to a shortest diameter of electron passing holes formed in the acceleration electrodes.

As can be understood from FIG. 8, assuming that the thickness of the electron passing hole AHL of the acceleration electrode G2 is Tg2 and the short diameter of the electron passing hole AHL is FG2, the thickness Tg2 of the electron passing hole AHL is expressed by Tg2min≦Tg2≦Tg2max and the minimum thickness Tg2min of the electron passing hole AHL is expressed by Tg2min=2.98FG2−0.04. Further, when the short diameter FG2 of the electron passing hole AHL assumes the relationship FG2<0.109, the maximum thickness Tg2max is expressed by Tg2max=0.02/(0.115−FG2)−0.06. Still further, when the short diameter FG2 of the electron passing hole AHL assumes the relationship FG2≧0.109, the maximum thickness Tg2max is expressed by Tg2max=0.03/(FG2−0.1)+0.045.

Further, in FIG. 8, the reason why the maximum thickness Tg2max of the electron passing hole AHL formed in the acceleration electrode G2 is expressed by two different functions using the short diameter FG2=0.109 as a boundary is that a crossover, which is a focusing point of electron beams formed by a control action of the control electrode G1, is shifted away from the electron source K along with the increase of the short diameter FG2 and falls outside the region of the acceleration electrode G2 in the vicinity of the short diameter FG2=0.109. Further, in the region where the short diameter FG2 assumes FG2>0.109, the electron beams which are focused due to the control action of the control electrode G1 are converted into the diverging direction due to the electric field of the acceleration electrode G2 before the crossover is formed.

Here, in FIG. 8, with respect to the relationship between the short diameter FG2 and the thickness Tg2 of the electron passing hole AHL formed in the acceleration electrode G2, a range G in a triangular shape at a center portion of the drawing indicates an optimum region; whereas, the other regions indicated by symbols B1 and B2 are regions where the electrons E impinge on the acceleration electrode G2, and the region indicated by symbol B3 indicates a region where the separation of the cathode electric field and the anode electric field is impossible.

Figure 9:
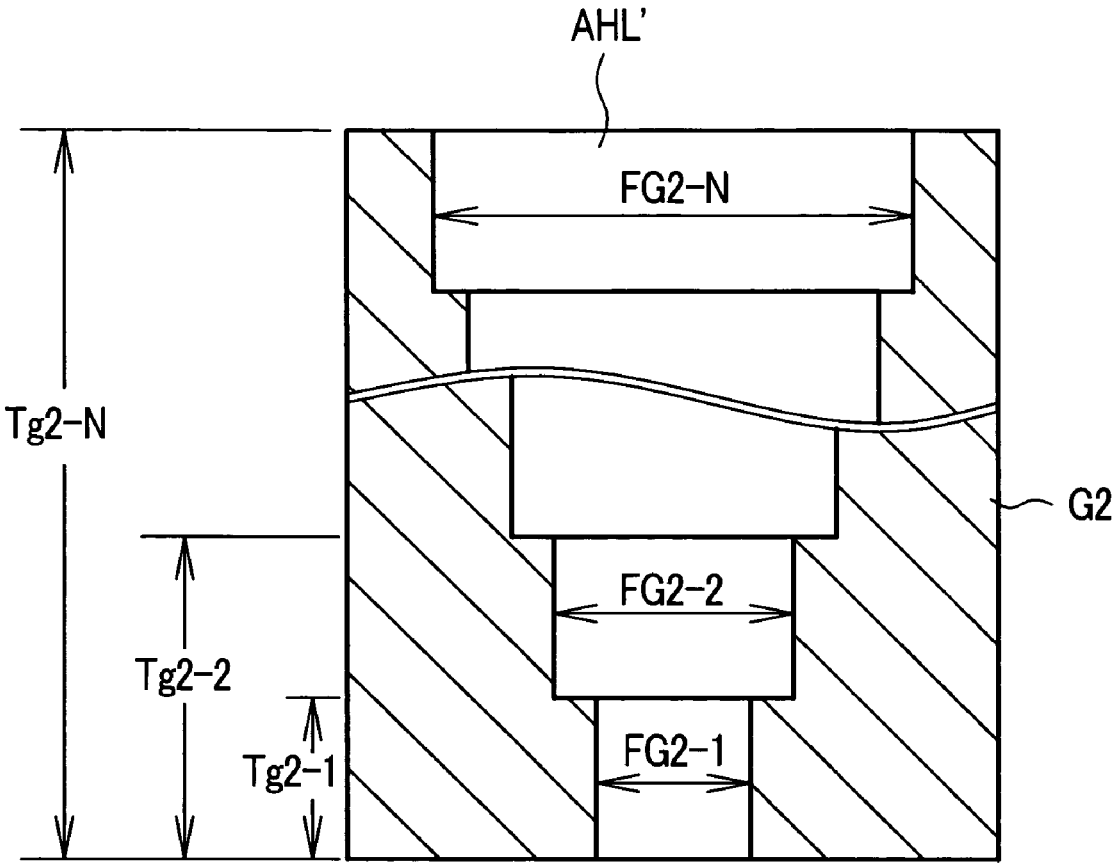
FIG. 9 is an enlarged cross-sectional view showing the constitution of electron passing holes formed in acceleration electrodes representing another embodiment of the image display device according to the present invention.

FIG. 9 shows an enlarged cross-sectional view of the acceleration electrode G2 representing another embodiment of the image display device according to the present invention. In FIG. 9, a point which makes this embodiment different from the embodiment shown in FIG. 1 lies in the fact that each electron passing hole AHL' which is formed in the acceleration electrode G2 is configured to have a multi-stage (N stages) structure in which the short diameter FG2 is sequentially enlarged in a step-like manner in the direction from the control electrode G1 to the anode ADE. The multi-stage structure of the electron passing hole AHL' is formed such that the short diameter FG2 increases in size in the order of short diameters FG2-1, FG2-2, . . . FG2-N in the direction from the electron source K to the anode ADE, and the thickness (depth) Tg2 is increased in the order of the thicknesses Tg2-1, Tg2-2, . . . Tg2-N corresponding to the respective short diameters.

In such a constitution, the minimum thickness Tg2min of the electron passing hole AHL' formed in the acceleration electrode G2 implies the shortest length which can ensure a non-electric field region in the inside of the electron passing hole AHL'. In the non-electric field region, since the electrons advance in a straight manner, provided that the structure sequentially enlarges the short diameters FG2-1, FG2-2, . . . FG2-N from the electron source K side, it is sufficient that the lengths of the non-electric field corresponding to the hole diameters of the respective stages satisfy a range from the minimum thickness Tg2min to the maximum thickness Tg2max.

Accordingly, assuming the open hole diameter and the open hole thickness of the Nth stage from the electron source K side are FG2-N and Tg2-N, respectively, and assuming values obtained by putting FG2-N into the short diameter FG2 in the previously-mentioned formula are Tg2min-N, Tg2max-N, the relationship FG2-1<FG2-1< . . . <FG2-N is established. Further, with respect to at least one Tg2-N, the relationship Tg2-N≧Tg2min-N is established. Still further, with respect to all Tg2-N, the relationship Tg2-N≧Tg2max-N may be established.

According to the constitutions of the above-mentioned respective embodiments, by the realization of the triode operation, the irregularities (fluctuation) of the light emission starting voltage attributed to the quality of the CNT is not converted into an elevation of the drive voltage, but can be converted into a DC bias voltage of the acceleration electrode G2, and, hence, the drive voltage can be reduced. Further, due to the realization of triode operation, the self-alignment of the electron emission portions of the electron source K and the electron passing holes EHL formed in the control electrode G1 is achieved, and, hence, the inflow current given to the control electrode G1 can be made zero due to the self-alignment of the electric field.

Further, according to the above-mentioned constitution, due to the tolerance in positioning between the effective region of the electron source K and the electron passing hole formed in the control electrode G1 and the tolerance in the control current, the effective region of the electron source K is not limited, and, hence, the maximum current can be obtained structurally. Further, since the electric field generated between the anode ADE and the acceleration electrode G2 and the electric field generated between the control electrode G1 and the electron source K can be separated, it is possible to independently optimize the electron emission characteristics and the electron beam focusing characteristics.

Further, with such a constitution, since the electric field generated between the anode ADE and the acceleration electrode G2 and the electric field generated between the electron source K and the control electrode G1 can be separated, the accuracy in size and the accuracy in assembly of the structural parts, such as spacers provided for holding a given distance between respective constitutional electrodes and the frame body provided for holding a given distance between the face panel PN2 and the back panel PN1, can be wholly alleviated.

Figure 10:
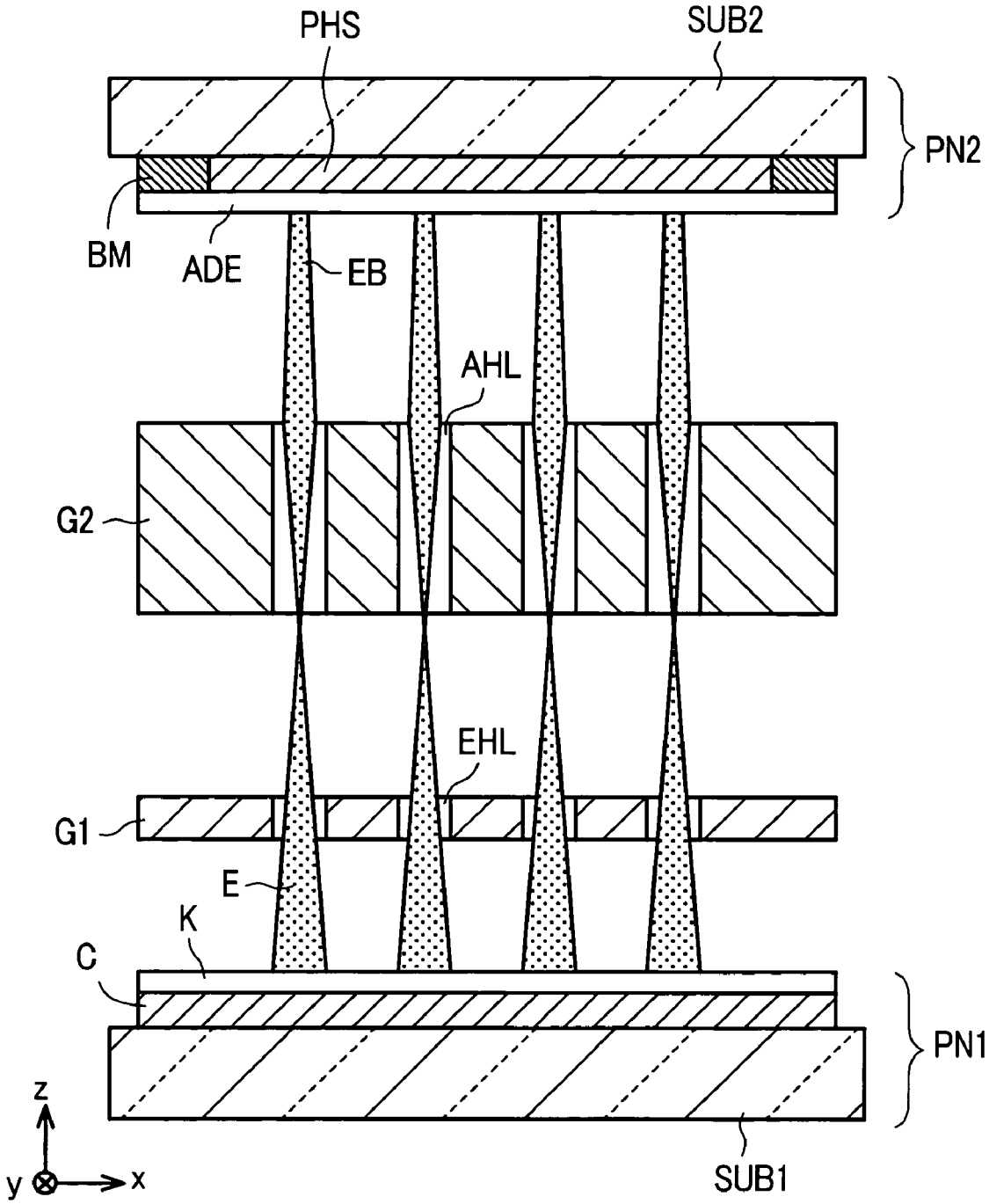
FIG. 10 is an enlarged cross-sectional view of the vicinity of one pixel for schematically showing the constitution of another embodiment of the image display device according to the present invention.

FIG. 10 is an enlarged cross-sectional view of the vicinity of one pixel schematically showing the constitution of another embodiment of the image display device according to the present invention. Parts identical to the above-mentioned parts shown in FIG. 1 are identified by the same symbols and their explanation is omitted. A point which makes the embodiment of FIG. 10 different from the embodiment shown in FIG. 1 lies in the fact that the cathode C is formed or matted on the whole inner surface of the back substrate SUB1, and the electron source K which emits electrons is formed or matted on the whole upper surface of the cathode C.

Here, the electron source K, which is matted on the whole upper surface of the cathode C, is made of CNT (carbon nanotubes), for example, and the electron source K is formed by applying an Ag-B-CNT paste to the cathode C by printing and baking the printed paste.

Further, at the face panel PN2 side, as viewed from the cathode C, a plurality of control electrodes G1, which are formed independently from each other and each of which includes a plurality of electron passing holes EHL for allowing electrons E from the electron source K to pass therethrough toward the face panel PN2 side, and a plurality of acceleration electrodes G2, which are formed independently from each other and each of which includes a plurality of electron passing holes AHL, are arranged in a state in which the electron passing holes EHL and the electron passing holes AHL are aligned coaxially with each other and respective electrodes are arranged in parallel with a given distance therebetween.

With such a constitution, a triode operation is performed, in which the control electrodes G1 have a potential lower than the potential of the cathode G1 and the electron sources K emit electrons E in response to the potential of the acceleration electrodes G2. The electrons E which are emitted from the electron sources K formed on the cathode C by the triode operation pass through the electron passing holes EHL formed in the control electrodes G1 in a state in which the electron quantity is controlled, and then, they pass through the electron passing holes ALH formed in the acceleration electrodes G2. Here, the electrons are accelerated by the electron passing holes AHL and are directed to the anodes ADE as electron beams EB so as to excite the phosphors PHS to make the phosphors PHS emit light at a given wavelength. A display region is formed on the face panel P2 by arranging the pixels two-dimensionally and images are displayed on the display region.

Figure 11:
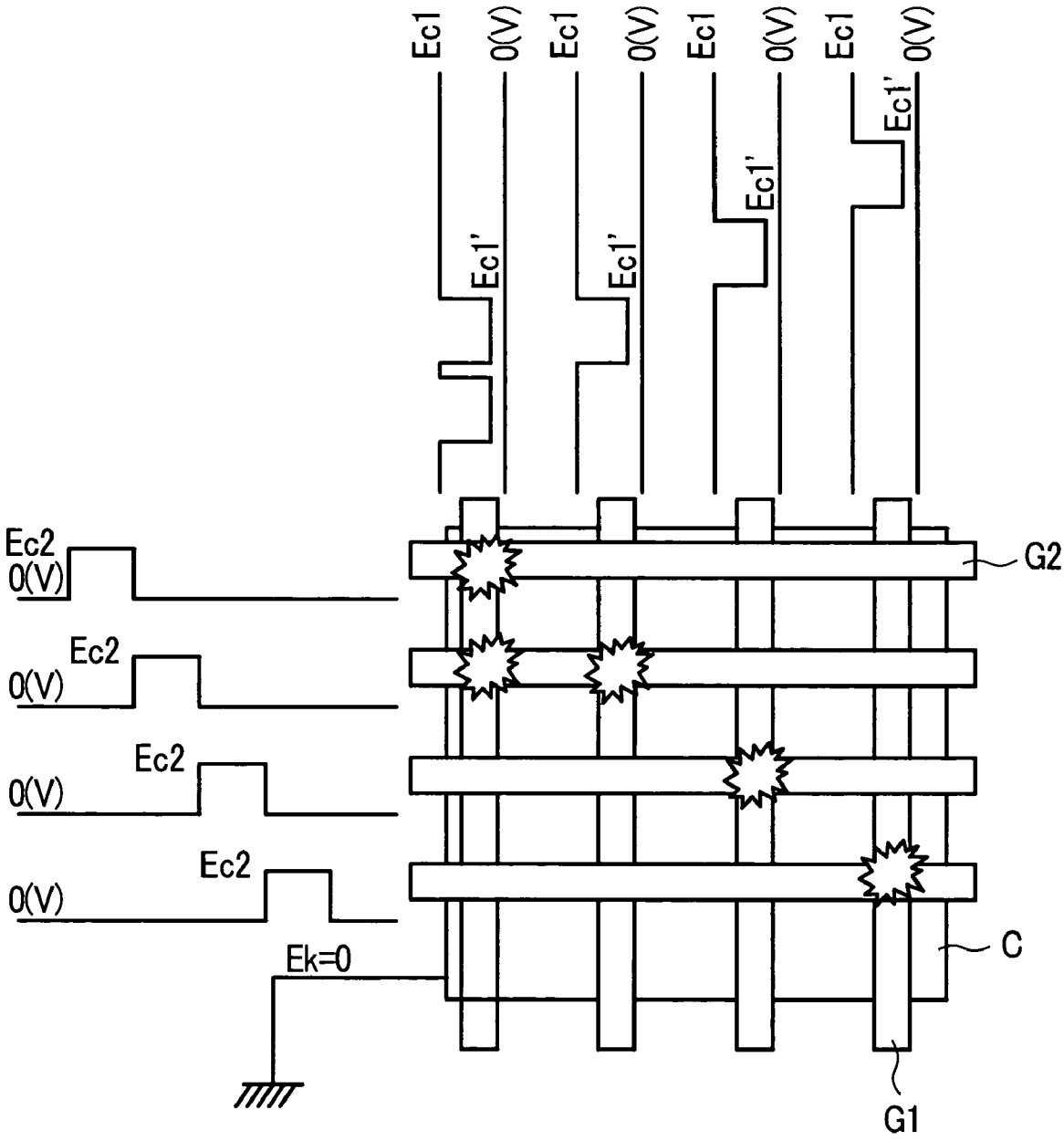
FIG. 11 is a timing chart of driving pulses applied to respective electrodes when a triode operation of the image display device shown in FIG. 10 is performed.

In such a triode operation, as shown in FIG. 11, a DC voltage Ek=0V is applied to the cathode C, which constitutes the electrode of a single potential in the whole area of the screen. Also, in performing the triode operation, a pulse voltage which assumes a control potential Ec1(OFF time) <Ec1'(ON time)<Ek is applied to the control electrode G1, and a pulse voltage which assumes 0V in an OFF time and an acceleration potential Ec2 in an ON time is applied to the acceleration electrode G2.

Figure 12:
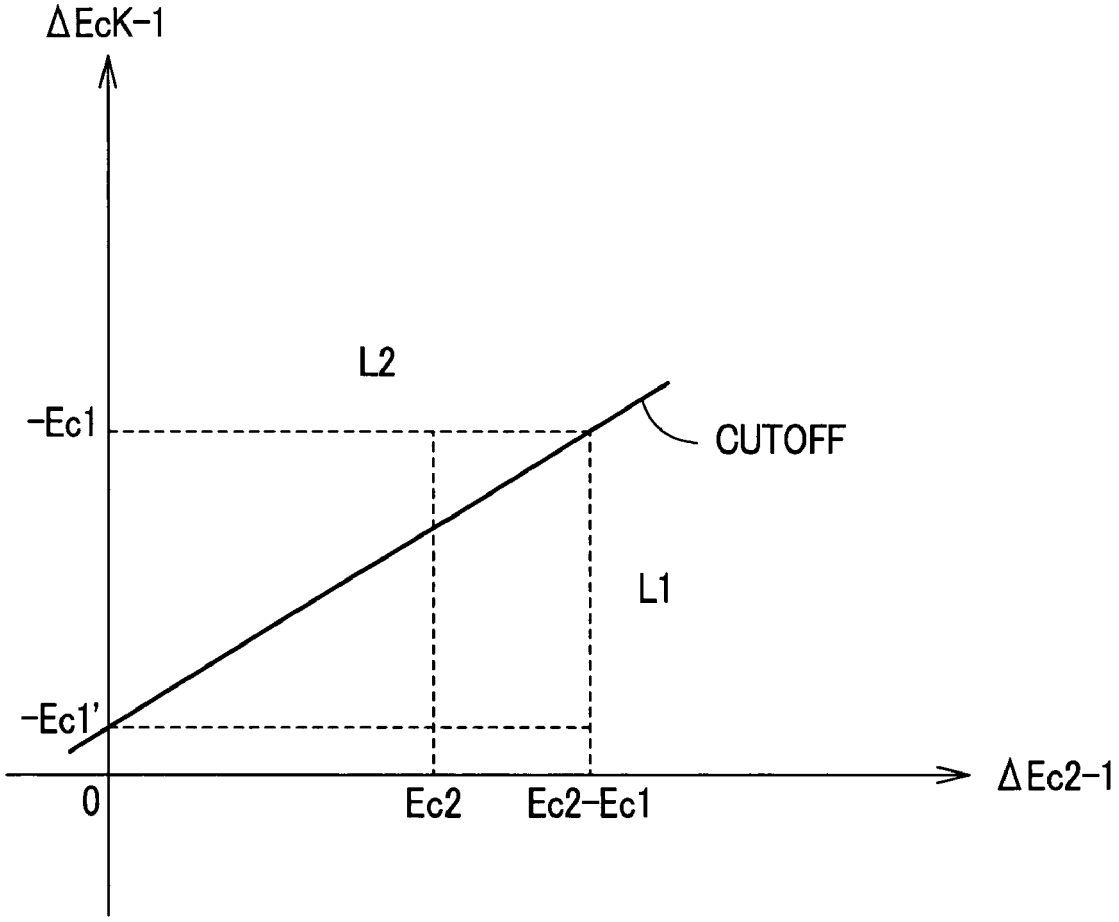
FIG. 12 is a graph showing the relationship of a cathode potential, a control electrode potential and an acceleration electrode potential with light emission.

FIG. 12 is a view showing the relationship among the potential of the cathode C, the potential of the control electrode G1, the potential of the acceleration electrode G2 and the emission of light when matrix driving is performed by the drive circuit shown in FIG. 11. In the drawing, a potential difference ΔEc2-1 between the potential Ec2 of the acceleration electrode G2 and the potential Ec1 of the control electrode G1 is taken on an axis of abscissas and a potential difference ΔEcK-1 between the potential Ek of the cathode C and the potential Ec1 of the control electrode G1 is taken on an axis of ordinates. Further, in the drawing, symbol L1 indicates a light emitting region, symbol L2 indicates a light non-emitting region, and symbol CUTOFF indicates the cutoff characteristics. Matrix driving is performed in conformity with the timing shown in following Table 1.

TABLE 1

| matrix driving | potential of control electrode | potential of acceleration electrode | presence or non-presence of light emission |
|---|---|---|---|
| line selection time (signal OFF) | Ec1 | Ec2 | light not emitted |
| line selection time (signal ON) | Ec1' | Ec2 | light emitted |
| line non-selection time (signal OFF) | Ec1 | 0 | light not emitted |
| line non-selection time (signal ON) | Ec1' | 0 | light not emitted |

In the above-mentioned explanation of the embodiment in conjunction with FIG. 11, although the acceleration electrode G2 side is used as the gate lines and the control electrode G1 side is used as the signal lines, it is needless to say that the control electrode G1 side may be used as the gate lines and the acceleration electrode G2 side may be used as the signal lines.

With such a constitution, the electron sources K of the cathode C and the electron passing holes EHL formed in the control electrodes G1 are aligned in a self-alignment manner due to the use of triode operation; and, at the same time, it is possible to set the inflow current to the control electrodes G1 to zero by the self-alignment of the electric field. Further, due to the tolerance in positioning and the tolerance in the control current, the effective diameter of the electron sources K of the cathode C is not limited, and, hence, it is possible to obtain the maximum current structurally.

Further, with such a constitution, it is possible to perform matrix driving using a single cathode C. Further, by adopting the triode electron emission structure, the position of the electron sources K of the cathode C is self-aligned based on the positions of the control electrodes G1 and the acceleration electrodes G2, and, hence, patterning of the electron sources K becomes completely unnecessary.

Here, in the above-mentioned embodiments, an explanation has been given with respect to a case in which the control electrodes G1 and the acceleration electrodes G2 are formed of a conductive metal plate material. However, it is needless to say that the present invention is not limited to such a case. That is, the control electrodes G1 and the acceleration electrodes G2 may be constituted of a laminated film electrode structure which is formed of conductive metal films. Further, the control electrodes G1 and the acceleration electrodes G2 may be constituted of a laminated electrode structure in which the control electrodes G1 are formed of a conductive metal film on the cathode line CL side of the insulation substrate and the acceleration electrodes G2 are formed of a conductive metal film on the anode ADE side of the insulation substrate. Still further, the control electrodes G1 and the acceleration electrodes G2 may be constituted of a laminated electrode structure in which the control electrodes G1 are formed of a strip-like electrode element (MRG) on the cathode line CL side of the insulation substrate and the acceleration electrodes G2 are formed of a conductive metal film on the anode ADE side of the insulation substrate. In these cases, it is also possible to obtain advantageous effects exactly equal to those described previously.

Further, in the above-mentioned respective embodiments, an explanation has been given with respect to a case in which the open hole shape of the respective electron passing holes formed in the control electrode G1 and the acceleration electrode G2 is oblong. However, the present invention is not limited to such a shape, and it is possible to obtain advantageous effects exactly equal to those described previously by adopting a circular shape, a rectangular shape or other various shapes as the open shape of the respective electron passing holes.

Here, in the above-mentioned respective embodiments, an explanation was given with respect to a case in which the present invention is applied to a field emission panel which is used as an image display device. However, it is needless to say that the present invention is not limited to such a case, and it is possible to obtain advantageous effects exactly equal to those described previously by applying the present invention to a display device, an image receiver set or the like which uses the field emission panel.

As has been explained heretofore, according to the image display device of the present invention, by defining the distance among the electron sources, the control electrodes and the acceleration electrodes, the thicknesses of the respective electrodes and the hole diameters of the respective electron passing holes, by applying a DC potential to the acceleration electrodes, by performing matrix driving using the cathode lines and the control electrodes and by performing triode electron emission, it is possible to obtain the high current density with low voltage driving. Accordingly, even when the CNT characteristics of the electron sources are deteriorated, it is possible to obtain the desired current without increasing the drive voltage, and, hence, a display device which exhibits higher brightness and higher reproducibility can be realized.

Further, it is also possible to obtain other extremely excellent advantageous effects including following advantageous effects. Due to the reduction of the drive voltage, it is possible to largely reduce the cost of the drive circuit and it is also possible to largely enhance the reliability of the image display device. Still further, the tolerance can be increased in all aspects compared to the diode operation, the yield rate can be largely enhanced and, at the same time, the accuracy of the constitutional parts can be alleviated, and, hence, individual costs of the respective constitutional parts can be largely reduced.

Further, according to the image display device of the present invention, by defining the distance among the electron sources, the control electrodes and the acceleration electrodes, the thicknesses of the respective electrodes and the hole diameters of the respective electron passing holes, the electric field generated between the anodes and the acceleration electrodes and the electric field generated between the control electrodes and the electron sources can be separated from each other; and, hence, the mutual influence between these electric fields can be eliminated, whereby it is possible to obtain the extremely excellent advantageous effect that optimization in the design can be realized by making the electron emission characteristics and the electron beam focusing characteristic independent from each other.

Still further, according to another example of the image display device of the present invention, by forming the cathode using a single electrode and applying a DC voltage to the cathode, by performing matrix driving using the control electrodes and the acceleration electrodes and by performing triode electron emission, the tolerance in positioning between the electron sources and the electron passing holes formed in the control electrodes and the tolerance in current of the control electrodes are enhanced, and, hence, the maximum current can be obtained structurally. Accordingly, the effective diameter of the electron sources is not limited, the formation of the fine pattern of the electron sources becomes no longer necessary, and the wiring pattern also becomes no longer necessary; and, hence, the structure is simplified, whereby it is possible to obtain excellent advantageous effects, including following advantageous effects. That is, the panel cost can be largely reduced. Since high accuracy of the parts and the assembly thereof is not strictly required, the yield rate can be largely enhanced.

What is claimed is:

1. An image display device comprising:

a face substrate which has anodes and phosphors formed on an inner surface thereof:

a back substrate, which has: a plurality of cathode lines which extend in one direction and are arranged in parallel in another direction which intersects one direction, which cathode lines include electron sources; control electrodes which are arranged to face the cathode lines in a non-contact manner and include a plurality of electron passing holes which allow electrons emitted from the electron sources to pass therethrough to an inner surface side of the face substrate in regions which respectively face the electron sources and control an emission quantity of electrons emitted from the electron sources; and acceleration electrodes which face the control electrodes in a non-contact manner, include a plurality of electron passing holes which allow the electrons which pass through the electron passing holes formed in the control electrodes to pass therethrough in regions which respectively face the respective electron passing holes formed in the control electrodes and which accelerate the electrons which pass through the electron passing holes on an inner surface thereof; said back substrate being disposed to face the face substrate with a given distance therebetween; and a frame body which is inserted between the face substrate and the back substrate while surrounding a display region so as to maintain a given distance between the face substrate and the back substrates; wherein assuming a distance between the electron sources and the control electrodes as Lkg, a distance between the control electrodes and the acceleration electrodes as L12, a thickness of the electron passing holes formed in the control electrodes as Tgl and a short diameter of the electron passing holes formed in the control electrodes as FGI, the acceleration electrodes satisfy the relationship (Lkg+Tgl+L12/2)/FGI≧0.25;

assuming a thickness of the electron passing holes formed in the acceleration electrodes as Tg2 and a short diameter of the electron passing holes of the acceleration electrodes as FG2, the acceleration electrodes satisfy the relationship Tg2min≦Tg2≦Tg2max and the relationship Tg2min=2.98FG2−0.04;

assuming FG2<0.109, the acceleration electrodes satisfy the relationship Tg2max=0.02/(0.115−FG2)−0.06; and assuming FG2≧0.109, the acceleration electrodes satisfy the relationship Tg2max=0.03/(FG2−0.1)+0.045.

2. An image display device comprising:

a face substrate which has anodes and phosphors formed on an inner surface thereof:

a back substrate, which has: a plurality of cathode lines which extend in one direction and are arranged in parallel in another direction which intersects one direction, which cathode lines include electron sources; control electrodes which are arranged to face the cathode lines in a non-contact manner and include a plurality of electron passing holes which allow electrons emitted from the electron sources to pass therethrough to an inner surface side of the face substrate in regions which respectively face the electron sources and control an emission quantity of electrons emitted from the electron sources; and acceleration electrodes which face the control electrodes in a non-contact manner, include a plurality of electron passing holes which allow the electrons which pass through the electron passing holes formed in the control electrodes to pass therethrough in regions which respectively face the respective electron passing holes formed in the control electrodes, the electron passing holes being formed while having an N-stage structure in which an open hole diameter thereof is gradually increased in the direction toward the face substrate, and which accelerate the electrons which pass through the electron passing holes toward the inner surface side of the face substrate on an inner surface thereof; and back substrate being disposed to face the face substrate with a given distance therebetween; and a frame body which is inserted between the face substrate and the back substrate while surrounding a display region so as to maintain a given distance between the face substrate and the back substrate; wherein assuming a distance between the electron sources and the control electrodes as Lkg, a distance between the control electrodes and the acceleration electrodes as L12, a thickness of the electron passing holes formed in the control electrodes as Tgl and a short diameter of the electron passing holes formed in the control electrodes as FGI, the acceleration electrodes satisfy the relationship (Lkg+Tgl+L12/2)/FGI≧0.25;

assuming a thickness of a first-stage open hole of the electron passing hole of the acceleration electrode as Tg2-1, a thickness of open holes ranging from the first-stage open hole to a Nth-stage open hole of the electron passing hole of the acceleration electrode as Tg2-N, a short diameter of the first-stage open hole of the electron passing hole of the acceleration electrode as FG2-1, a short diameter of the Nth-stage open hole of the electron passing hole of the acceleration electrode as FG2-N, a minimum value of a thickness of open holes ranging from the first-stage open hole to the Nth-stage open hole as Tg2min-N, and a maximum value of a thickness of open holes ranging from the first-stage open hole to the Nth-stage open hole as Tg2max-N, the acceleration electrodes satisfy the relationship FG2-1<FG2-2< . . . <FG2-N;

wherein with respect to at least one Tg2-N, the relationship Tg2-N≧Tg2min-N is satisfied, and with respect to all Tg2-N, the relationship Tg2-N≦Tg2max-N is satisfied.

3. An image display device according to claim 1, wherein the electron sources are made of carbon nanotubes.

4. An image display device comprising:

a face substrate which has anodes and phosphors formed on an inner surface thereof:

a back substrate, which has: cathodes which form electron sources on a display region; control electrodes which are arranged to face the cathodes in a non-contact manner and include a plurality of electron passing holes which allow electrons emitted from the electron sources to pass therethrough to an inner surface side of the face substrate in regions which respectively face the electron sources and control an emission quantity of electrons emitted from the electron sources; and acceleration electrodes which face the control electrodes in a non-contact manner, include a plurality of electron passing holes which allow the electrons which pass through the electron passing holes formed in the control electrodes in regions which respectively face the respective electron passing holes formed in the control electrodes and which accelerate the electrons which pass through the electron passing holes toward the inner surface side of the face substrate on an inner surface thereof; said back substrate being disposed to face the face substrate with a given distance therebetween; and a frame body which is inserted between the face substrate and the back substrate while surrounding a display region so as to maintain a given distance between the face substrate and the back substrate; wherein assuming a distance between the electron sources and the control electrodes as Lkg, a distance between the control electrodes and the acceleration electrodes as L12, a thickness of the electron passing holes formed in the control electrodes as Tgl and a short diameter of the electron passing holes formed in the control electrodes as FGI, the acceleration electrodes satisfy the relationship (Lkg+Tgl+L12/2)/FGI≧0.25;

assuming a thickness of the electron passing holes formed in the control electrodes as Tg2 and a short diameter of the electron passing holes of the acceleration electrodes as FG2, the acceleration electrodes satisfy the relationship Tg2min≦Tg2≦Tg2max and the relationship Tg2min=2.98FG2−0.04;

assuming FG2<0.109, the acceleration electrodes satisfy the relationship Tg2max=0.02/(0.115−FG2)−0.06; and assuming FG2≧0.109, the acceleration electrodes satisfy the relationship Tg2max=0.03/(FG2−0.1)+0.045; and matrix driving is performed using the control electrodes and the acceleration electrodes.

5. An image display device according to claim 4, wherein the electron sources are made of carbon nanotubes.

6. An image display device according to claim 1, wherein the control electrodes and the acceleration electrodes adopt a laminated film electrode structure in which the control electrodes are formed of a first conductive metal film and the acceleration electrodes are formed of a second conductive metal film.

7. An image display device according to claim 1, wherein the control electrodes and the acceleration electrodes adopt a laminated electrode structure in which the control electrodes are formed on the cathode line side of the insulation substrate using a first conductive metal film and the acceleration electrodes are formed on the anode side of the insulation substrate using a second conductive metal film.

8. An image display device according to claim 1, wherein the control electrodes and the acceleration electrodes adopt a laminated electrode structure in which the control electrodes are formed on the cathode line side of the insulation substrate using a strip-like electrode element and the acceleration electrodes are formed on the anode side of the insulation substrate using a conductive metal film.

* * * * *